US006601805B1

(12) United States Patent
Kapp

(10) Patent No.: US 6,601,805 B1
(45) Date of Patent: Aug. 5, 2003

(54) COLLAPSIBLE ART EASEL

(75) Inventor: Dennis Kapp, St. Petersburg, FL (US)

(73) Assignee: Martin Universal Design, Detroit, MI (US)

( * ) Notice: Subject to any disclaimer, the term of this patent is extended or adjusted under 35 U.S.C. 154(b) by 0 days.

(21) Appl. No.: 09/954,848

(22) Filed: Sep. 18, 2001

(51) Int. Cl.[7] ..... A47B 97/04

(52) U.S. Cl. ..... 248/171; 248/449; 248/450; 248/464; 248/465

(58) Field of Search ..... 248/170, 171, 248/172, 173, 440, 440.1, 463, 464, 465, 188.6, 441.1, 447, 450, 460, 462, 449; 403/97; D6/310, 311, 312

(56) References Cited

U.S. PATENT DOCUMENTS

| | | | | | |
|---|---|---|---|---|---|
| 298,257 | A | * | 5/1884 | Vail | 182/109 |
| 414,987 | A | * | 11/1889 | McDonald | 248/449 |
| 544,083 | A | * | 8/1895 | Beyer | 248/449 |
| 624,662 | A | * | 5/1899 | Leedy | 248/171 |
| 1,517,825 | A | * | 12/1924 | Bruneau | 248/171 |
| 1,782,118 | A | * | 11/1930 | Cahall | 248/170 |
| 1,795,747 | A | * | 3/1931 | Viken | 248/171 |
| 1,879,865 | A | * | 9/1932 | Wright | 248/157 |
| 2,032,872 | A | * | 3/1936 | Friedrichs | 248/449 |
| 2,613,901 | A | * | 10/1952 | Tatar | 248/167 |
| 2,744,712 | A | * | 5/1956 | Brandt | 108/11 |
| 2,845,244 | A | * | 7/1958 | Prokop | 160/24 |
| 3,190,597 | A | * | 6/1965 | Bieschke | 160/24 |
| 3,304,045 | A | * | 2/1967 | Bethoney | 248/170 |
| 3,417,952 | A | * | 12/1968 | Bieschke | 248/171 |
| 3,759,482 | A | * | 9/1973 | Wright | 249/449 |
| 4,988,064 | A | * | 1/1991 | Hoshino | 248/165 |
| 5,435,509 | A | * | 7/1995 | Bingham | 248/159 |
| 5,636,824 | A | * | 6/1997 | Biasini et al. | 248/441.1 |
| 5,979,856 | A | * | 11/1999 | Hsu | 248/441.1 |
| 6,092,770 | A | * | 7/2000 | Battocchio | 248/166 |
| 6,179,266 | B1 | | 1/2001 | Hutten | 248/465 |
| 6,202,974 | B1 | | 3/2001 | Rellinger | 248/460 |
| 6,206,183 | B1 | * | 3/2001 | Helsel | 206/1.7 |
| 6,260,812 | B1 | * | 7/2001 | Auke | 248/447 |

FOREIGN PATENT DOCUMENTS

| | | | | |
|---|---|---|---|---|
| CA | 545994 | * | 9/1957 | 248/171 |
| DE | 828444 | * | 1/1952 | 248/170 |
| FR | 351799 | * | 7/1905 | 248/465 |

OTHER PUBLICATIONS

Photographs Studio RTA Easel.

* cited by examiner

*Primary Examiner*—Ramon O. Ramirez
*Assistant Examiner*—Jon Szumny
(74) *Attorney, Agent, or Firm*—Rader, Fishman & Grauer, PLLC

(57) ABSTRACT

An improved collapsible easel having a plurality of support legs, a spine member and a board support. The support legs include at least one rear support legs and two front support legs. A top portion of each of the support legs are connected to an upper retaining mechanism that is selectively frictionally engaged with the spine member such that the height of the upper retaining mechanism may be selectively adjusted. Front support braces having first and second brace ends have a first brace end connected to front support legs and a second brace end pivotally connected to the lower retaining mechanism. Rear support braces having first and second ends have a first brace end connected to a rear support leg and a second brace end connected to the lower retaining mechanism.

19 Claims, 5 Drawing Sheets

COLLAPSIBLE ART EASEL

FIELD OF THE INVENTION

The present invention relates generally to collapsible easels, and more specifically, to a collapsible easel having improved stability.

BACKGROUND OF THE INVENTION

Collapsible easels are known. Typical easels include an arrangement of spaced apart legs. In some known easels, the legs of the easel are made up of telescoped tubes or foldable struts that are extendable linearly to a predetermined height. A display support platform is generally placed across at least two legs. The display platform is generally movable, and in some instances may be removable.

One known prior art easel having a board support includes a plurality of legs. The legs are generally pivotally spread apart, with one end of secured to an easel tripod. Each leg includes multiple interlocked sections that are biased together when in an assembled position, but may be selectively manipulated for separation and folding into a bundle with one section against another. A board support is mounted on two legs, but may be selectively moved to a desired position on any of the interlocking sections. Each board support is relatively small with a general C-shape configuration. The board supports are pivotally mounted, such that they are pivotal between two positions, one where it is folded against the leg on which it is mounted and one where it is folded away from the leg. The board supports serve to hold a small section of a canvas or other item when folded away from the leg.

While portable, known art easels as described above have disadvantages. For example, the legs and the board supports are unstable and not suitable for holding heavy boards or paintings. Moreover, because the board supports are so small, height adjustment is limited by the width of the article being displayed.

Another known prior art easel includes to front support legs having an upper end connected to a selectively movable retaining mechanism. A single support brace that is selectively movable, extends laterally to connected the two front support legs together. A rear support leg is hingedly connected to a separate upper plate that is frictionally engaged with a central member. Rear support braces have a first end pivotally connected to a portion of the rear support leg and a second end pivotally connected to a fixed location on a portion of the central member. A board support is removably mounted to a front portion of the central member.

While prior easels of this type are collapsible and relatively lightweight, they are difficult to set up into an operative position that is stable. For example, the front support legs and the rear support legs must be separately adjusted until the easel is balanced due to the separate connection of the support braces and support legs. Accordingly, more time is required to insure an operative set up of the easel. Moreover, experimentation is required to properly balance the easel among the support legs.

Therefore, there exists a need for a collapsible easel that is easy to set up, but provides increased stability over prior art easels.

SUMMARY OF THE INVENTION

The present invention is directed to an improved collapsible easel which is relatively light weight, but has increased stability over prior art easels. The inventive easel includes a spine member, at least two front support legs and at least one rear support leg, a plurality of front and rear support braces and a board support. The spine member includes an outwardly extending rear portion that is flanked on each side by a shoulder support. A mounting channel is formed in the rear portion. It is preferred that rear portion and the mounting channel extend the length of the spine member such that the spine member may be cost-effectively manufactured by extrusion or the like. However, it is understood that the rear portion and/or the mounting channel may be formed only on predetermined portion of the spine member.

The spine member has an upper connection mechanism and a lower connection mechanism mounted on the rear portion. Both the upper and lower connection mechanisms include a U-shaped portion and a planar portion. The U-shaped portion is positioned around the rear portion of the spine member with arms of the U-shaped portion contacting the support shoulders on the spine member. The planar member is positioned adjacent to the U-shaped portion such that the outermost section of the U-shaped portion spaces the arms of the U-shaped portion away from the planar portion to form mounting channels.

In the upper connection mechanism, the mounting channels receive upper section of front support legs that are pivotally mounted thereto such that the front support legs are pivotable in a first plane of direction. A hinge member has one leaf secured to an outside surface of the planar member and a second end secured to an upper portion of the rear support leg such that the rear support leg is pivotal in a second plane of direction that is different from the first plane of direction.

In the lower connection member, the mounting channels receive brace ends from front support braces. The front support braces are pivotally connected to the lower connection member such that the support braces are movable in the first plane of direction. Opposite ends of the support braces are connected to a portion of the front support legs for pivotal movement.

A generally C-shaped mounting bracket is fixedly secured to an outside surface of the planar member of the lower connection mechanism. At least one end of a rear support brace is pivotally mounted to ears on the mounting bracket. The other end of the rear support brace is pivotally connected to the rear support leg. Preferably, the rear support brace includes an elongated slot with an access opening for selective removal of the rear support from the rear support leg.

In accordance with one aspect of the invention, each support leg has at least two support braces associated with it for increase stability. Preferably, the support braces are arranged in a spaced parallel manner with first brace ends mounted on opposite sides of each support leg.

The board support is selectively movable along the front of the spine member. It may be selectively turned or even removed. A board retaining member may also be provided to secure a top portion of an article being displayed. The board retaining member is selectively movable along the front of the spine member to position the board support at a predetermined height and may be selectively turned or even removed.

Unlike the prior art, the support legs are all secured to the two connection mechanisms. For example, the upper portions of the support legs are secured to a single upper connection mechanism. Similarly, the support braces all have one end secured to a common lower connection mechanism. Thus, the support legs are all connected together, providing ease of set up and greater stability for the easel.

BRIEF DESCRIPTION OF THE DRAWINGS

The features and inventive aspects of the present invention will become more apparent upon reading the following detailed description, claims, and drawings, of which the following is a brief description:

DETAILED DESCRIPTION OF PREFERRED EMBODIMENTS

Figure 1:
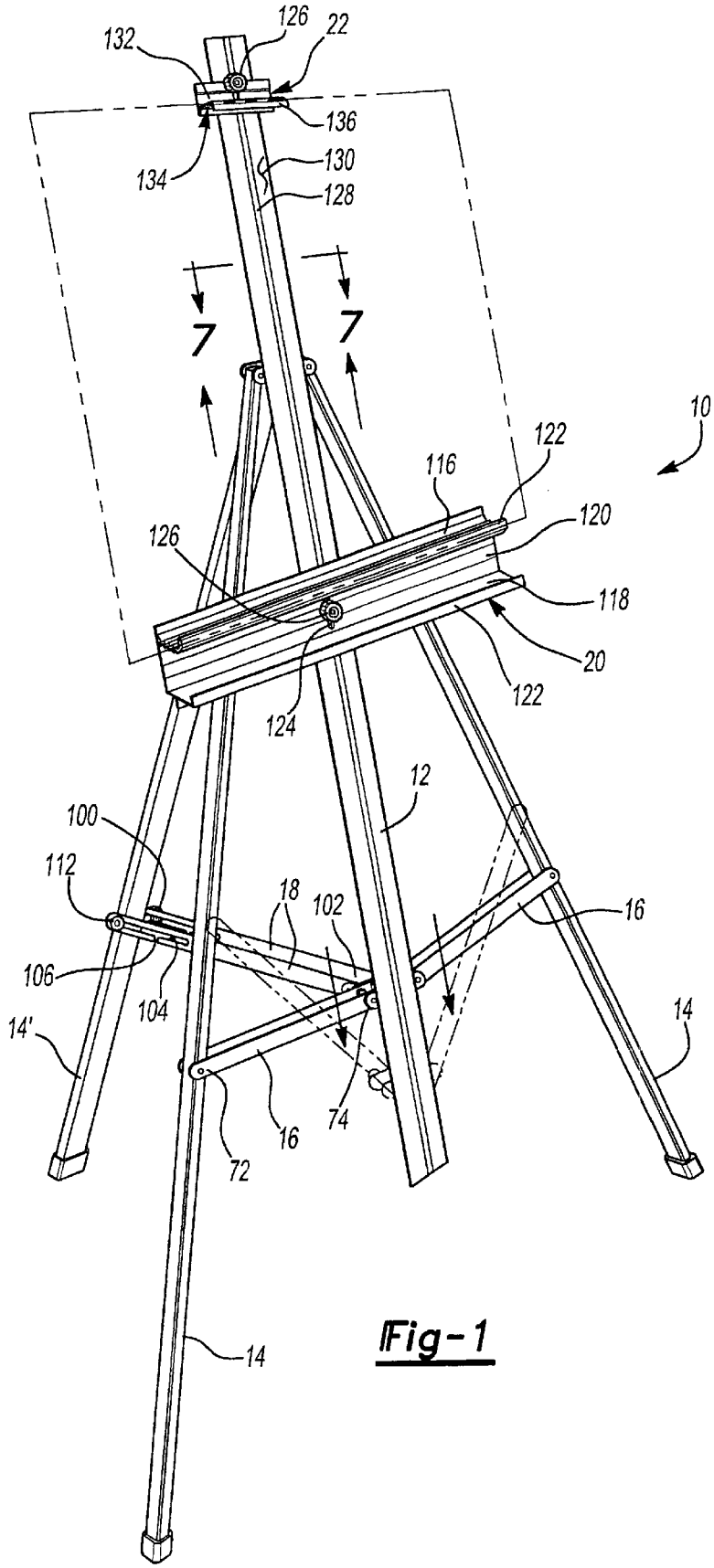
FIG. 1 is a perspective view of the front of a collapsible easel according to the present invention and illustrated in its extended and erected position.

FIGS. 1–7 disclose an improved easel 10 in accordance with the present invention. Easel 10 includes a spine member 12, a plurality of support legs 14, front support braces 16 and rear support braces 18. A board support 20 and a board retaining member 22 are also provided.

Figure 2:
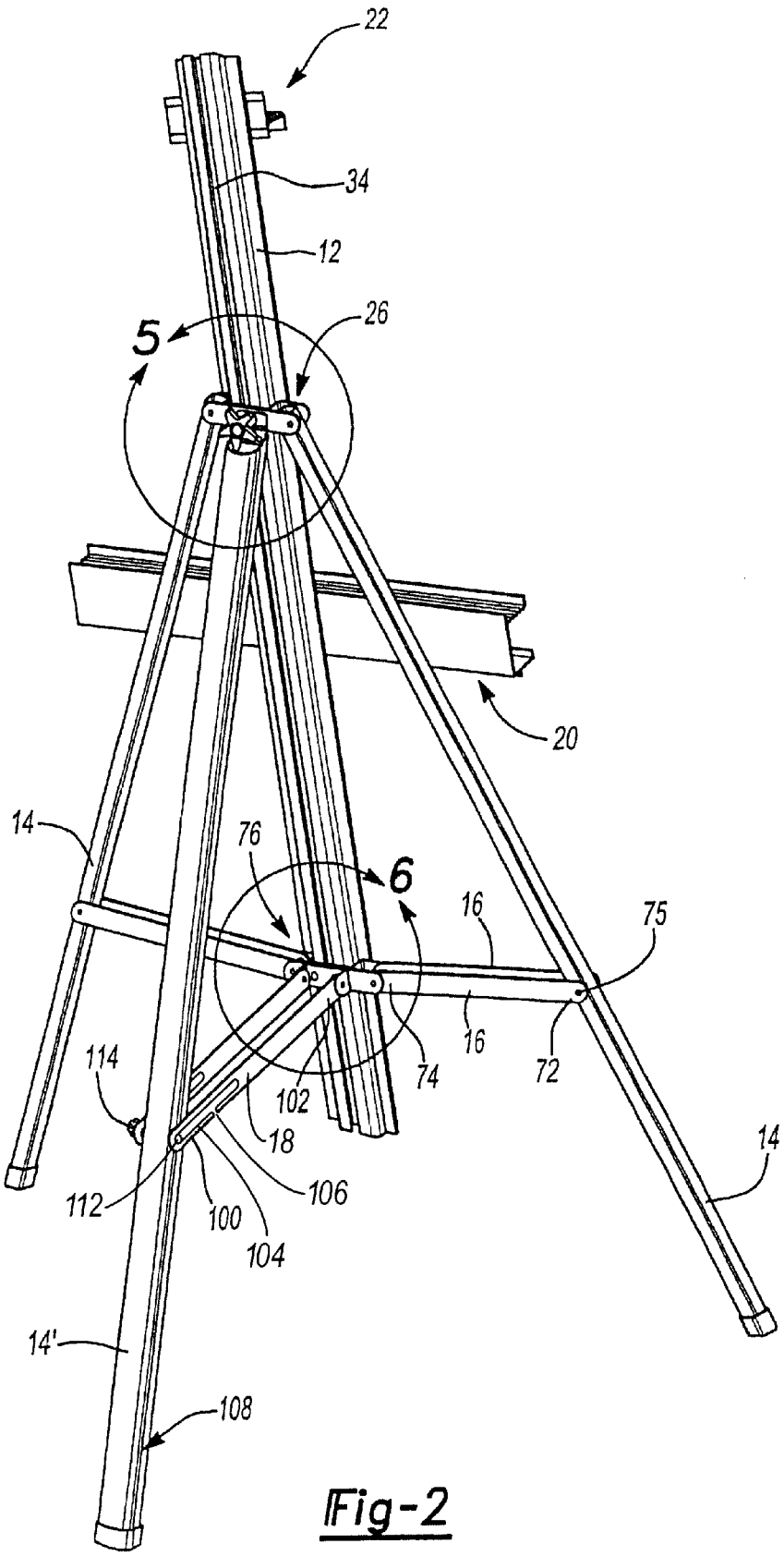
FIG. 2 is a perspective view of the rear of the collapsible easel of FIG. 1.
Figure 5:
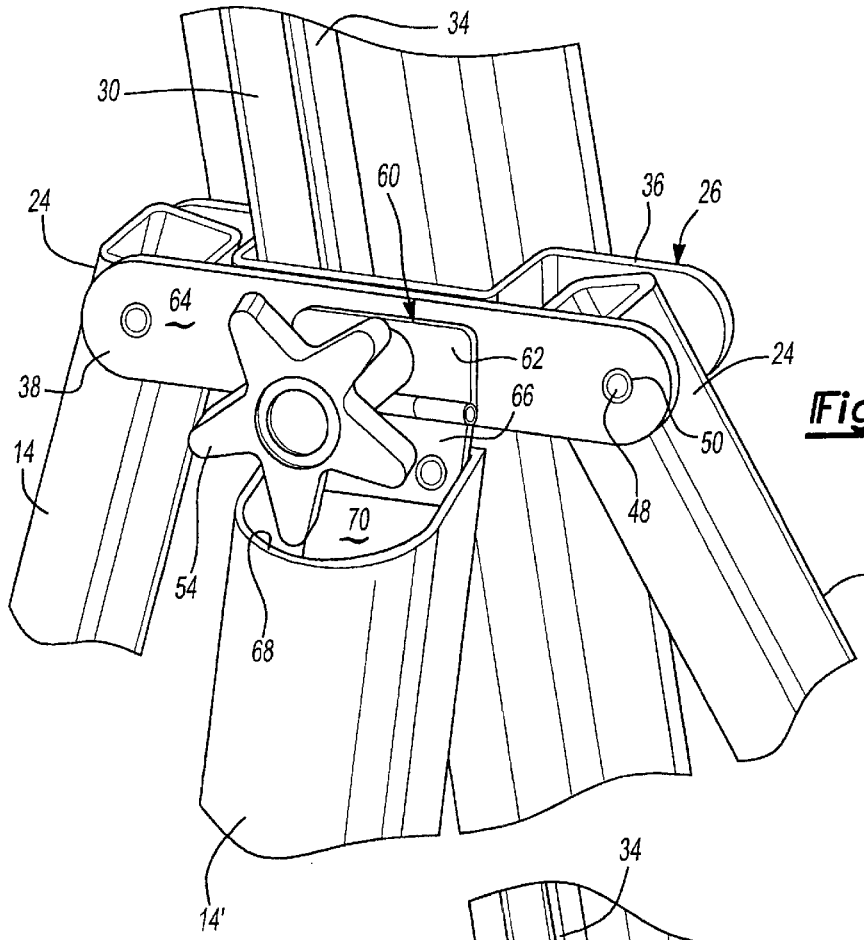
FIG. 5 is a blow-up of the area marked as 5 from FIG. 2 showing an upper rear connection mechanism for legs of the collapsible easel.
Figure 7:
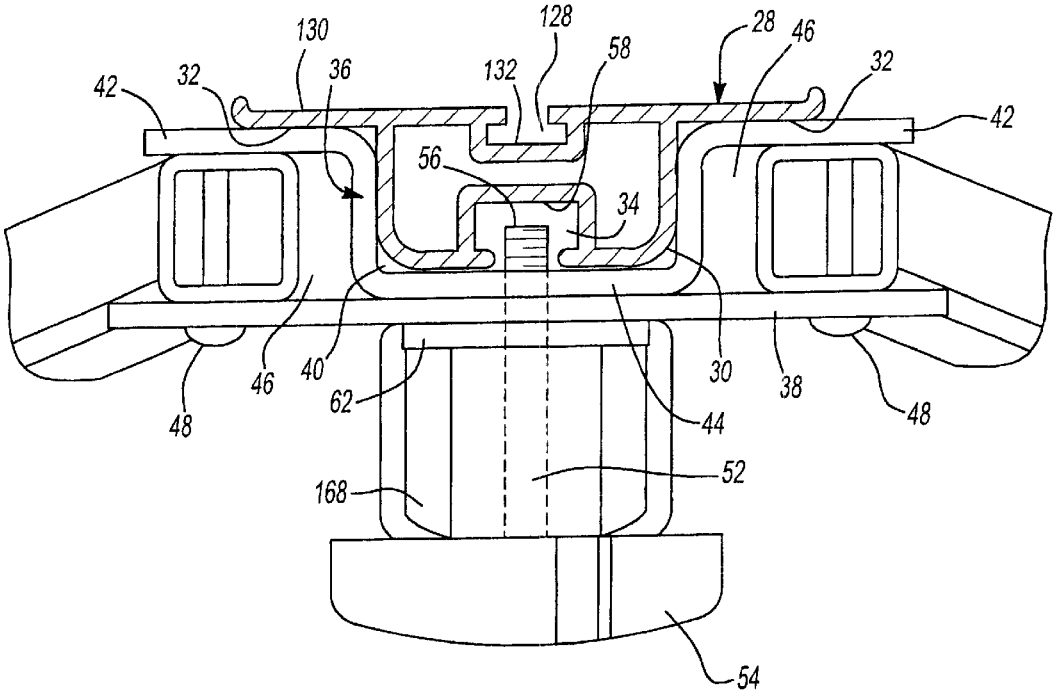
FIG. 7 is a blow up of the top view of the upper rear connection mechanism taken from FIG. 1.

In accordance with the invention, support legs 14 are pivotally connected to spine member 12 by at least one connection mechanism. In the preferred embodiment, a top portion 24 of each support leg 14 is pivotally connected to an upper rear connection mechanism 26. Upper rear connection member 26 is best seen in FIGS. 2, 5 and 7.

As can be seen, upper rear connection mechanism 26 is slidably engaged with spine member 12. Spine member 12 has a generally planar front surface 28 and an outwardly extending rear portion 30. Rear portion 30 has a width that is smaller than the width of front surface 28. Support shoulders 32 flank rear portion 30. A channel 34 is formed in approximately the center of rear portion 30, wherein channel 34 is open towards the rear of spine member 12. While channel 34 is shown extending the length of rear portion 30, it is understood that channel 34 may be provided in varying lengths along predetermined sections of rear portion 30.

Upper rear connection member 26 includes a generally U-shaped member or portion 36 and a generally planar member 38. U-shaped member 36 is sized and shaped to generally correspond to the rear contour of spine member 12 such that rear portion 30 is received within a groove 40 formed by U-shaped member 36, with arms 42 of U-shaped member 26 being positioned against support shoulders 32. Planar member 38 is positioned adjacent U-shaped member 36 such that planar member 38 is spaced from arms 42, but proximate to an outermost portion 44 of U-shaped member 36. Planar member 38 need not be secured to U-shaped member 36, although it is understood that planar member 38 may be secured directly to outermost portion 44 without departing from the present invention.

Arms 42 and planar member 38 cooperate to form a mounting channel 46. In accordance with the present invention, mounting channels 46 receive end portions 24 of support legs 14. End portions 24 are pivotally mounted in mounting channels 46 by a pin 48 or other suitable mechanism that is received through mounting aperture 50 (best seen in FIG. 5) such that support legs 14 are selectively movable in a first plane of direction, to be explained in further detail below.

In accordance with another aspect of the invention, planar member 38 and U-shaped member 36 have corresponding apertures (not shown) therethrough that are adapted to received a screw mechanism 52, or the like. In a preferred embodiment, screw mechanism 52 includes a handle 54 or knob fixedly secured thereto. A distal end 56 of screw mechanism 52 engages a rear wall 58 of channel 34 to selectively secure upper rear retaining mechanism 26 at a predetermined height along spine member 12.

Planar member 38 further includes a hinge 60 (best seen in FIG. 5) having a first leaf 62 fixedly secured to an outer surface 64 of planar member 38 and a second leaf 66 secured to a rear support leg 14'. In the preferred embodiment, rear support leg 14' is generally hollow with an open end 68 such that second leaf 66 may be fixedly secured to an internal surface 70 of open end 68. Accordingly, rear support leg 14' is hingedly connected rear connection mechanism 26 such that rear support leg 14' is selectively movable in a second plane of direction that differs from the first plane of direction in which support legs 14 are movable.

Easel 10 further includes front support braces 16. Front support braces 16 have first and second brace ends 72 and 74. First brace ends 72 are pivotally connected to support leg 14 by a pin 75 or other suitable mechanism. Second brace ends 74 are pivotally connected to a lower rear connection member 76 (best seen in FIG. 6). Lower rear connection member 76 is similar in construction to upper connection member 26 in that it includes a generally U-shaped member 78 and a generally planar member 80. As with upper rear connection member 26, U-shaped member 78 is slidably engaged with spine member 12 such that rear portion 30 of spine member 12 is received within a groove 82. Similarly, planar member 80 is positioned adjacent U-shaped member 78 such that arms 84 of U-shaped member are spaced from planar member 80 to cooperate to form a mounting channel 86. Mounting channels 86 each receive second brace ends 74. Second brace ends 74, planar member 78 and U-shaped member 76 all having corresponding mounting apertures 88 that receive a pin 90 or other suitable mechanism to pivotally connect second brace ends 74 to lower rear connection member 76 such that front support braces 16 are pivotal in a first plane of direction.

Lower rear connection member 76 further includes a generally C-shaped mounting bracket 92 having a base 94 and outwardly facing corresponding ears 96. Base 94 is fixedly secured to planar member 78 such that ears 96 are facing away from planar member 78. Ears 96 each include a mounting aperture 98 to be explained in further detail below.

Easel 10 is also provided with at least one rear support brace 18. Rear support brace 18 includes a first brace end 100 and a second brace end 102. First brace end 100 has an elongated slot 104 extending therefrom. Slot maybe provided with an optional access opening 106 that is positioned at a distance from first brace end 100 of least at half the length of elongated slot 104.

In accordance with one aspect of the invention, side surfaces 108 of rear support leg 14' each include a mounting aperture (not shown) formed therein. A pin 112 or other suitable mechanism pivotally connects first brace end 100 to rear support brace 18 such that rear support brace 18 is pivotally movable in a second plane of direction that differs from the first plane of direction of front support braces 16. Preferably, pin 112 includes a knob 114 or handle to easily detach rear support brace 18, to be explained in further detail below.

Second brace end 102 is positioned adjacent an ear 96 of mounting bracket 94. Second brace end 1.02 includes a mounting aperture 118 (best seen in FIG. 6) that corresponds to mounting aperture 98. A pin or other suitable mechanism is inserted through mounting apertures 98 and 118 such that second brace end 102 is pivotally connected to mounting bracket 94 to permit selective adjustment of rear support leg 14' in a second plane of direction.

To provide stability to easel 10, it is preferred that there are at least a pair of front support braces 16 for each support leg 14. In accordance with the present invention, front support braces 16 are positioned parallel to one another, but spaced apart. First brace ends 72 are positioned on opposite sides of support legs 14 and pivotally connected together by pin 75 or related mechanism. Similarly, second brace ends 74 are connected together within mounting channel 86. While it is understood that second brace ends 74 may be positioned on either side of arms 78 and the distal end of planar member 78, it is preferred that second brace ends 74 are positioned within mounting channel 86 to reduce debris and other foreign matter from interfering with the pivoting action of front support braces 16.

Figure 6:
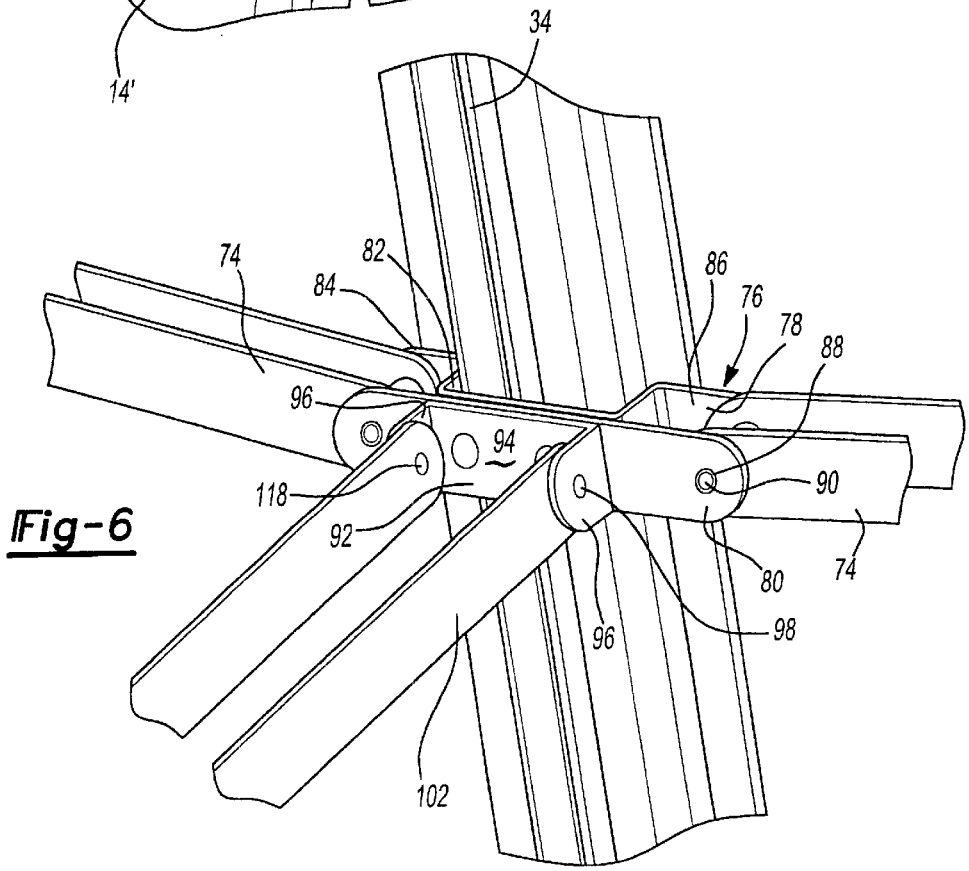
FIG. 6 is a blow-up of the area marked as 6 from FIG. 2 showing a lower rear connection mechanism for the legs of the collapsible easel.

It is also preferred that there is at least a pair of rear support braces 18 to provide stability and durability to easel 10. Rear support braces 18 are positioned so as to be spaced apart and parallel to one another. Further, first brace ends 100 are pivotally connected together by a pin or other suitable mechanism. Second brace ends 102 are pivotally connected to ears 96, preferably along an inside surface as shown in FIG. 6, of mounting bracket 76. It is understood however, that mounting bracket 92 may have other shapes, such a U-shape similar to U-shaped member 76 with second brace ends 102 being mounted on an outside surface.

Figure 3:
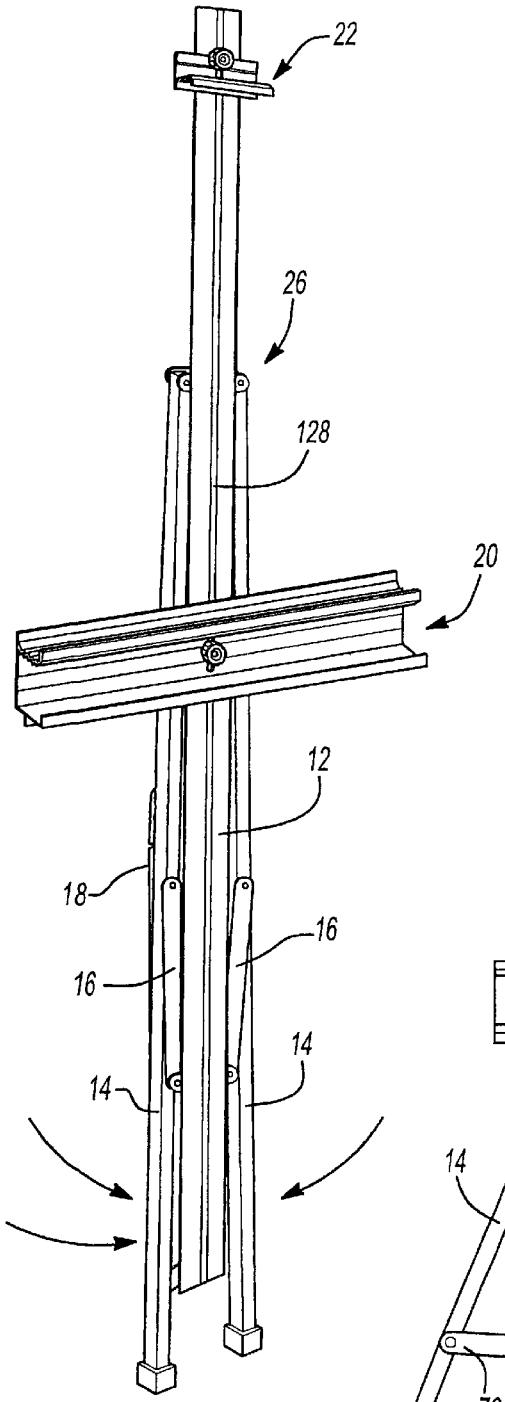
FIG. 3 is a perspective view of the front to the collapsible easel of FIG. 1, in a collapsed position.
Figure 4:
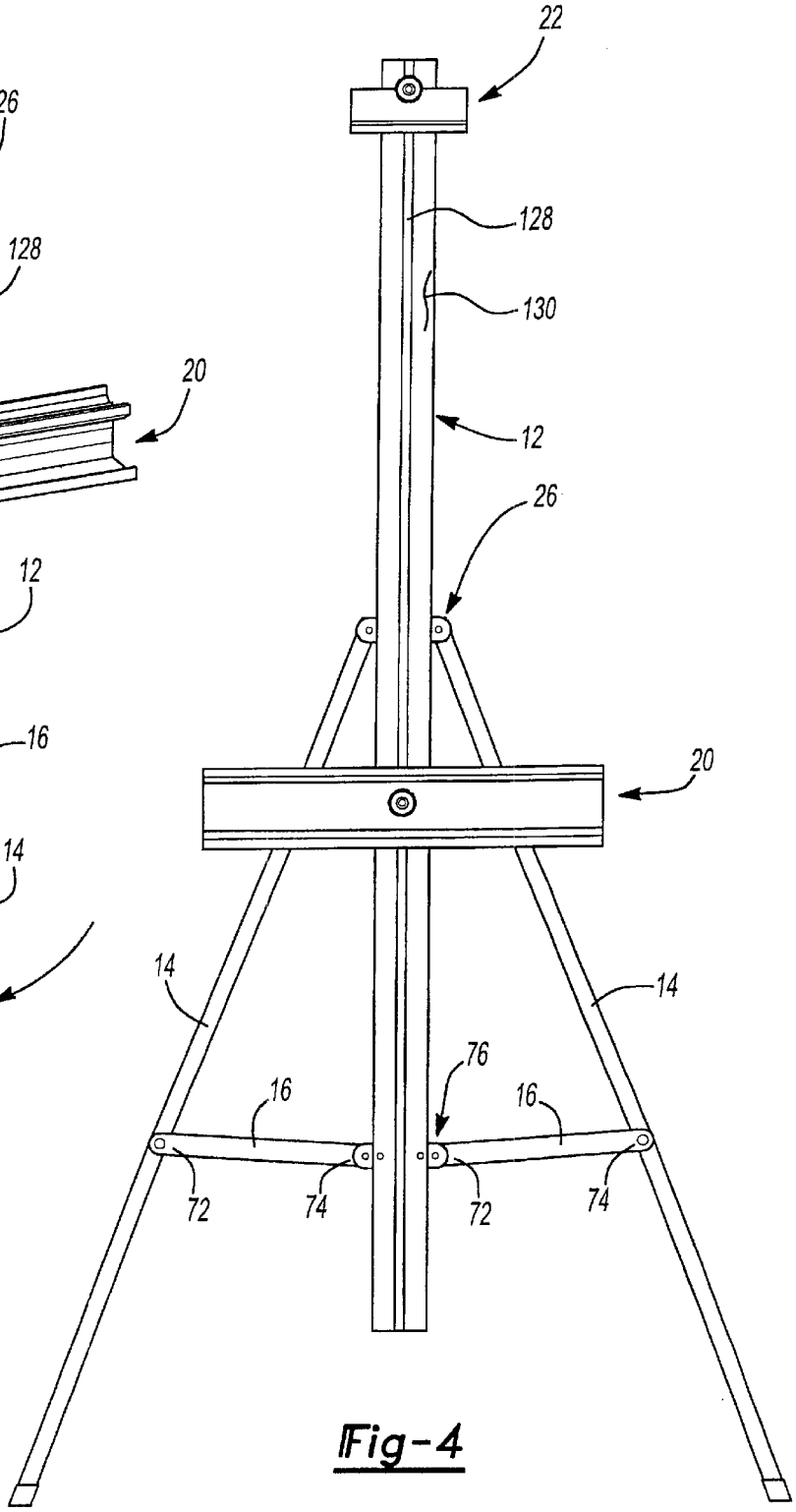
FIG. 4 is a front planar view of the collapsible easel.

Easel 10 further includes an elongated board support 20, as best seen in FIGS. 1, 3–4. Board support 20 includes at least one shelf 116 for holding a painting, canvas or the like. Preferably, board support 20 includes parallel shelves 116 and 118 spaced apart a predetermined distance and connected by a mounting wall 120. Shelf 118 may be used for holding painting or drawing supplies or the like. Both shelves 116 and 118 are provided with lips 122 that extend upwardly from a forward edge of each shelf 116. 118. Mounting wall 120 preferably includes a mounting aperture 124 (not shown) through which a screw mechanism, or similar device is inserted. Preferably, screw mechanism includes a knob 126 that is accessible to a user. A distal end of the screw is provided with a generally flat guide washer (not shown) that engages a generally C-shaped channel 128 formed in a front surface 130 of easel 10 (best seen in FIG. 7). When knob 126 is turned in a first predetermined direction, the guide washer frictionally engages a rear wall 132 in channel 128. In the preferred embodiment, channel 128 extends the length of the spine member 12 to permit a user to selectively move board support 20 to any desired height. It is understood, however, that channel 128 may be formed in select areas of spine member 12 and a cross aperture (not shown) sized slightly larger than the guide washer being provided at a desired location along the spine member 12 to limit the height of board support 20 relative to the remainder of easel 10.

Easel 10 may also include a board retaining member 22. Board retaining member 20 has a mounting wall 132 and a shelf 134 with a downwardly extending lip 136. Shelf 134 cooperates with shelf 116 to securely retain a canvas or painting on easel 10. Board retaining member 22 is mounted to spine member 12 in a manner similar to board support 20.

In accordance with another aspect of the invention, easel 10 is selectively collapsible for easy transport. As can be seen in FIG. 3, to collapse easel 10, rear support leg 14' is pivoted toward spine member 12. In response to the pivoting action, pin 112 slides along elongated slot 104. If an access opening 106 is provided, pin 112 is slid out of access opening 106 and rear support braces 18 are pivoted upward toward spine member 12 and positioned on either side of rear portion 30 that preferably extends the length of spine member 12. Alternatively, elongated slot 104 is sized to such that rear support leg 14' may be pivoted toward spine member 12. Next, rear support leg 14' is pivoted toward spine member 12.

Support legs 14 are each pivoted inwardly toward spine member 12. Lower rear retaining mechanism 76 slides downwardly along rear portion 30, pivoting front support braces 16 such that first brace ends 16 are moving in an upward direction as support legs 14 move toward spine member 12.

Board support 20 may also be disengaged from spine member 12. Knob 124 is turned in a second predetermined direction until the screw mechanism is loosened within channel 128. Once loose, board support 20 may be turned to align with spine member 12 and knob turned in the first predetermined direction to secure board support 20 to the remainder of easel 10. Board retaining member 22 may similarly be turned. Alternatively, board support 20 and board retaining member 22 may be selectively removed from spine member 12 by loosening the screw mechanism and sliding the board support 20 upwardly or downwardly toward an open end of spine member 12. If the end of spine member 12 is closed, board support 20 may be slid to a cross aperture to be released.

To position easel 10 into an erect and operable position, as shown in FIGS. 1 and 2, leg supports 14 are moved outwardly within the first plane of direction. Front support braces 16 are pivoted outwardly. Rear support braces 18 are engaged with pin 112 such that pin 112 is positioned within elongated slot 104. Rear support leg 14' is moved outwardly away from spine member 12 causing lower rear retaining mechanism to slide upwardly until easel is properly balanced between support legs 14, 14'. Because support legs 14, 14' are all connected to a common retaining mechanism, easel provides increased stability and ease of set up over prior art easels.

Preferred embodiments of the present invention have been disclosed. A person of ordinary skill in the art would realize, however, that certain modifications would come within the teachings of this invention. Therefore, the following claims should be studied to determine the true scope and content of the invention.

What is claimed is:

1. An improved collapsible easel, comprising:

at least three support legs including at least two front support legs and at least one rear support leg;

a spine member;

a board support; and an upper connection mechanism secured to said spine member;

wherein an upper distal end of each of said support legs is pivotally connected to said upper connection mechanism having a U-shaped portion and a generally planar member such that said two front support legs are pivotable in a first plane of direction and said rear support leg is pivotable in a second plane of direction that is different from said first plane of direction; and wherein said spine member has an outwardly extending rear portion with a mounting groove formed therein, wherein said U-shaped portion is positioned around said rear portion and selectively secured to said spine member by a retaining mechanism that is selectively frictionally engaged with a rear wall of said mounting groove.

2. The easel of claim 1, wherein said first plane of direction is generally perpendicular to said second plane of direction.

3. The easel of claim 1, wherein said board support is selectively moveable along said spine member to a predetermined height.

4. The easel of claim 1, further including a board retaining member.

5. The easel of claim 1, wherein said planar member is positioned adjacent to said U-shaped portion with said planar member being positioned proximate to said outermost portion of said U-shaped portion with arms of said U-shaped portion being spaced from said planar member, wherein said arms and said planar member cooperate to form mounting channels to receive ends of said leg supports.

6. The easel of claim 5, wherein said at least one rear leg support is hingedly connected to said planar member.

7. The easel of claim 1, further including a lower connection member operatively connected to said spine member for selective sliding movement, wherein said support legs are operatively connected at a second portion of said support legs to said spine member.

8. The easel of claim 7, further including support braces having first and second ends, said first ends being pivotally connected to support legs, said second ends being pivotally connected to said lower connection mechanism.

9. The easel of claim 8, wherein said support braces include at least two forward support braces and at least one rear support brace, wherein said rear brace includes an elongated slot that engages a pin for sliding movement.

10. An improved collapsible easel, comprising:

at least three support legs;

a spine member;

a board support;

wherein said support legs are pivotally connected to an upper connection mechanism that is frictionally engaged with said spine member;

a plurality of support braces, each of said support braces having a first brace end pivotally connected to one of said plurality of support legs and a second brace end pivotally connected to a lower connection member that is slidingly mounted on said spine member; and wherein said spine member includes an outwardly extending rear portion flanked on each side by a mounting shoulder, said rear portion further including a mounting channel formed therein, said mounting channel being open toward the rear surface of said spine member.

11. The easel of claim 10, wherein said upper connection mechanism includes a generally U-shaped portion and a generally planar portion, said U-shaped portion being sized to receive said rear portion within a groove and having arms that engage said mounting shoulders.

12. The easel of claim 11, wherein said generally planar portion is positioned adjacent to said U-shaped portion such that a generally central section of said planar portion is proximate to an outermost surface of said rear portion such that said planar portion is spaced away from said arms of said U-shaped portion to form mounting channels for receiving upper ends of front support legs, said support legs being mounted for pivotal movement in a first plane of direction.

13. The easel of claim 12, further including a hinge mechanism having one leaf operatively connected to said planar portion of said upper connection mechanism and a second leaf operatively connected to an upper end of at least one rear support leg.

14. The easel of claim 10, wherein said support braces include at least two forward support braces and at least one rear support brace, wherein said rear brace includes an elongated slot that engages a pin mounted on a rear support leg for sliding movement.

15. The easel of claim 14, wherein the elongated slot further includes an access opening for selectively connecting said rear support leg to said spine member.

16. The easel of claim 14, wherein there are at least two forward support braces connected to each support leg such that support braces are positioned parallel to one another and are spaced apart.

17. The easel of claim 16, wherein said lower connection mechanism includes a generally U-shaped portion and a generally planar portion, said U-shaped portion being sized to receive said rear portion within a groove and having arms that engage said mounting shoulders.

18. The easel of claim 17, wherein said planar member is positioned adjacent to said U-shaped portion with said planar member being positioned proximate to said outermost portion of said U-shaped portion with arms of said U-shaped portion being spaced from said planar member, wherein said arms and said planar member cooperate to form mounting channels to receive ends of said leg supports such that said leg supports are pivotally mounted to said retaining mechanism for selective pivotal movement in a first plane of direction.

19. The easel of claim 18, wherein at least one rear leg support is hingedly connected to said planar member such that said rear leg supports are selectively pivotable in a second plane of direction that is different from said first plane of direction.

* * * * *